US005148512A

United States Patent [19]

Owens

[11] Patent Number: 5,148,512

[45] Date of Patent: Sep. 15, 1992

[54] HAIR DRYER WITH AIR DELIVERY SHROUD PROVIDING SMALL EXHAUST OPENINGS HAVING METALLIC HEAT TRANSFER MEANS

[76] Inventor: James L. Owens, 77-14 113th St., Apt. 5-0, Forest Hills, N.Y. 11375

[21] Appl. No.: 562,483

[22] Filed: Aug. 3, 1990

[51] Int. Cl.[5] ..... A45D 20/00; F24H 1/10; H05B 1/00

[52] U.S. Cl. ..... 392/383; 34/97; 34/243 R; 132/212; 132/271; 219/222; 392/379

[58] Field of Search ..... 392/379-385, 392/365-368; 219/222, 225, 226; 34/96-101, 243 R; 132/212, 219, 117, 118, 112-116, 271

[56] References Cited

U.S. PATENT DOCUMENTS 3,365,811 1/1968 Djenner ..... 132/271 X
3,981,314 9/1976 Barradas ..... 132/271 X
3,990,460 11/1976 Shalvoy ..... 132/271 X

*Primary Examiner*—Anthony Bartis
*Attorney, Agent, or Firm*—Schweitzer, Cornman & Gross

[57] ABSTRACT

A hand-held hair dryer includes a shroud surrounding an electric heater and defining a passage for delivery of blown air from a blower to a heated air exhaust opening at an end of the shroud. The shroud is provided with a plurality of smaller air exhaust orifices adjacent to and/or forward of the heater upstream of the air exhaust opening. The orifices are arranged in one or more rows and each orifice is associated with a metallic secondary heat transfer means for improving transfer of heat to the exterior of the shroud. The part of the shroud containing the orifices may be rotatable about the circumference of the shroud to change the direction of air flow. The heat transfer means may comprise a single metal plate containing the plurality of orifices or an individual metallic member associated with each orifice.

13 Claims, 3 Drawing Sheets

HAIR DRYER WITH AIR DELIVERY SHROUD PROVIDING SMALL EXHAUST OPENINGS HAVING METALLIC HEAT TRANSFER MEANS

FIELD OF THE INVENTION

The present invention relates to a hair dryer, more particularly the present invention relates to improvements in hair drying for accelerated drying of hair.

BACKGROUND OF THE INVENTION

Conventional hair dryers generally have a fan which sucks air from the exterior through an air intake, and then blows it past one or more electrical heating elements where the blown air is heated. The heated air continues along its path within the hair dryer to a relatively large orifice through which the heated air is blown to the exterior of the dryer, usually onto the hair adjacent to which the dryer is being held. The dryer is moved along the hair to achieve drying of the entire hair.

Drying is accomplished solely by way of convection which comprises the blowing of the hot air onto the hair. It is well known to increase the rate of convection by applying a constrictor over the blowing orifice thereby to increase the pressure of the blown air and thus the velocity of the blown hot air, thereby to intensify drying and increase penetration of the hot air throughout the hair.

An aim of hair dryer design has been to increase the drying rate of hair. This has been achieved by increasing the volume of air delivered by the blowers such as by changing the design of the fan or by accelerating its rotation. Increasing the fan performance is often combined with increasing the size and voltage of the heating coils to transfer more heat to the air blown past the heating coils and out through the drying orifice. In the wattage race in hair dryer design, the provision for 1,200 watt/hour power has become commonplace.

In the usual form of prior art hair dryers the heater or heaters are surrounded by a tubular or annular shroud, the air is blown through that tubular shroud past the heaters and, except for any added constrictor elements, the end of the tubular shroud is usually open and comprises the large orifice through which the heated air is blown.

These aforementioned design changes have increased drying capacity to a finite limit to preserve the hand held character of the hair dryer. Therefore, there is a need in the field of hair dryer design yet further to increase the drying capacity of hair dryers without increasing their wattage requirements and maintaining weight and ease of use for continued ability to use a dryer in a hand held manner.

SUMMARY OF THE INVENTION

The higher rate of heat transfer to the hair and the faster drying of hair than heretofore possible is accomplished in accordance with the present invention by a hair dryer having a fan for blowing hair, and an electrical heater for heating of blown hair. A shroud surrounds the heater and the heated air passes through the shroud. A plurality of small orifices are provided in the shroud and heated air is blown through these orifices to the exterior of the shroud. Heat transfer means of a metal are associated with these orifices for improving the transfer of heat from the shroud through the orifices.

The "smaller" as applied to the orifices in accordance with the present invention relates the size to the conventional single larger orifice in hair dryers of the prior art. The conventional large orifice, as indicated, is usually about the same size as the diameter of the shroud. The smaller orifices, as the term is used throughout the specification and the claims refer to a size which is a small fraction of the conventional larger orifice. The diameter of the smaller orifices can suitably vary between from about $\frac{1}{4}$ of a centimeter to about 2 cm. Most suitable they are between from about $\frac{1}{2}$ centimeter to about $\frac{3}{4}$ centimeter.

The orifices are arranged in the shroud through a single row or suitably in a plurality of rows in which the orifices are suitably staggered relative to an orifice in an adjacent row. The orifices do not extend over the entire length of the shroud, but only along the portion of the shroud either immediately exterior of the heating elements or somewhat forward thereof after the air passes the elements, or both. The row or rows of orifices suitably extend over about or slightly less than one quarter of the circumference of the shroud. The shroud can be rotated advantageously about the heating elements to provide for optimum circumferential disposition of the orifices. Usually this comes into play when a user of the hair dryer holds it with either the left or the right hand, to enable arrangement of the orifices to face toward the hair to be dried. Thus, in use, it is the side of the shroud with its orifices which faces the hair to be dried, rather than the end through which the heated air is emitted in hair dryers of the prior art.

Most suitably a portable hair dryer of the prior art is provided with a row or rows of orifices on the side of the shroud, so that, if desired, the larger, axial opening at the end of the shroud can also be employed. In this case, however, a constrictor of any desired conventional design should be slipped over the larger orifice of the prior art hair dryer, if the orifices on the side of the shroud are to be employed.

The orifices and the associated secondary heat transfer means can either be a heat accumulator sleeve each disposed about the periphery of one of the orifices, the heat accumulator being a metal element disposed both within and outside the shroud, or can be a single metal member, such as of aluminum, fastened into a cutout in the shroud and having holes therein, as the orifices.

In addition to being rotatable, the shroud can also be removed and exchanged for another kind of shroud and heat accumulator design.

Suitably the larger, conventional hair drying orifice may be covered entirely or may be covered by an air flow constrictor.

BRIEF DESCRIPTION OF THE DRAWING

The invention is disclosed further through preferred embodiments in greater detail with reference being had to the drawing wherein.

DESCRIPTION OF PREFERRED EMBODIMENT

Figures 1, 6:
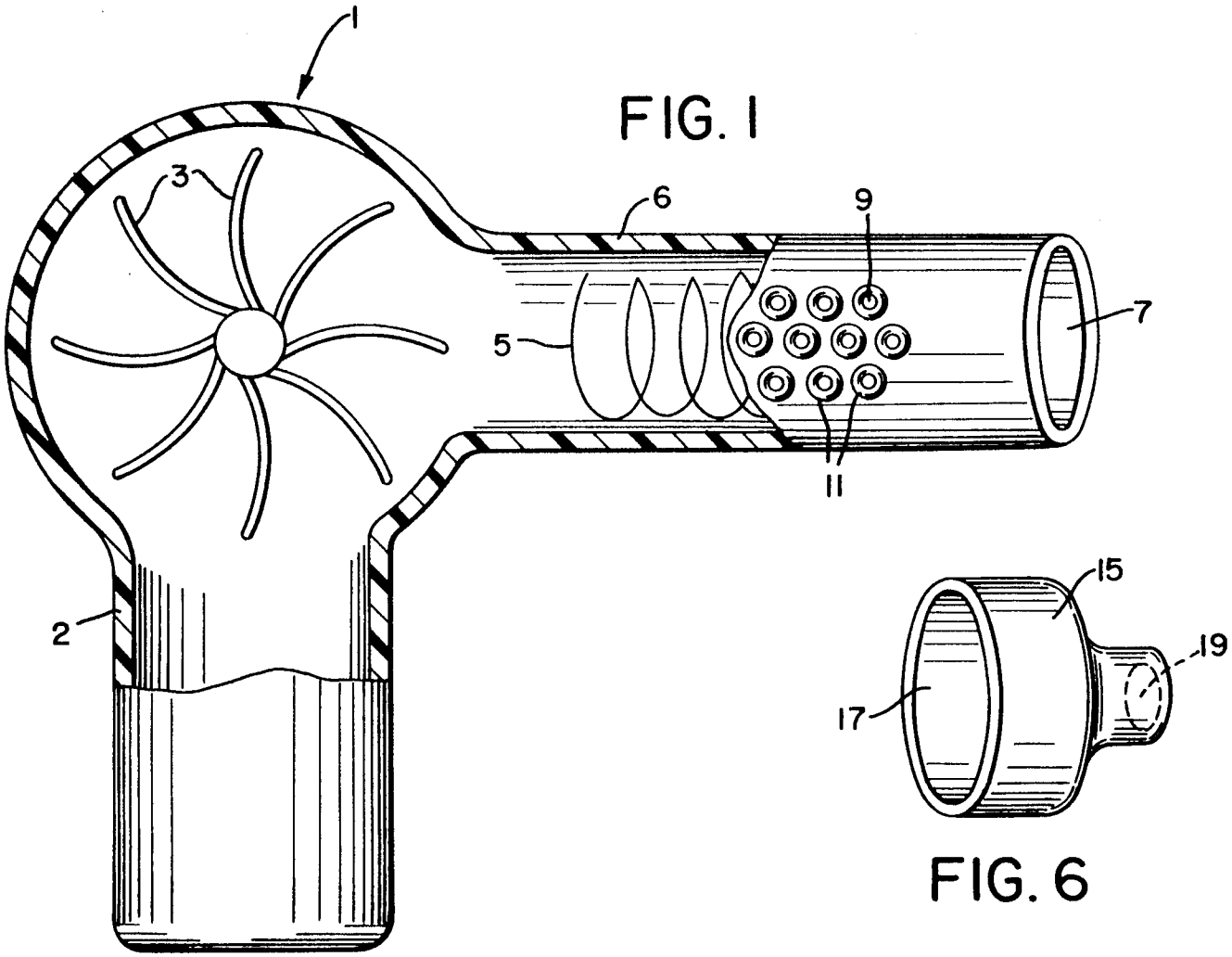
FIG. 1 is a schematic partial cross sectional representation of a portable hair dryer in accordance with the present invention.
FIG. 6 is a schematic showing of a conventional flow constrictor.

The hair dryer 1 is shown in FIG. 1, having a handle 2 for holding it by the operator. Fan blades 3 are rotated by a motor (not shown). Air is drawn in from the exterior by the fan blades 3 and is blown through a shroud or barrel 6, suitably of circular cross section. Heating coils 5 are disposed within the shroud 6 and the heated air moving past the coils 5 is driven in the general direction of the large exhaust orifice 7.

Three rows of small exhaust orifices 9 are arranged staggered relative to each other on the side of the shroud or barrel 6, generally about and forward of the heating coils 5.

Figure 2:
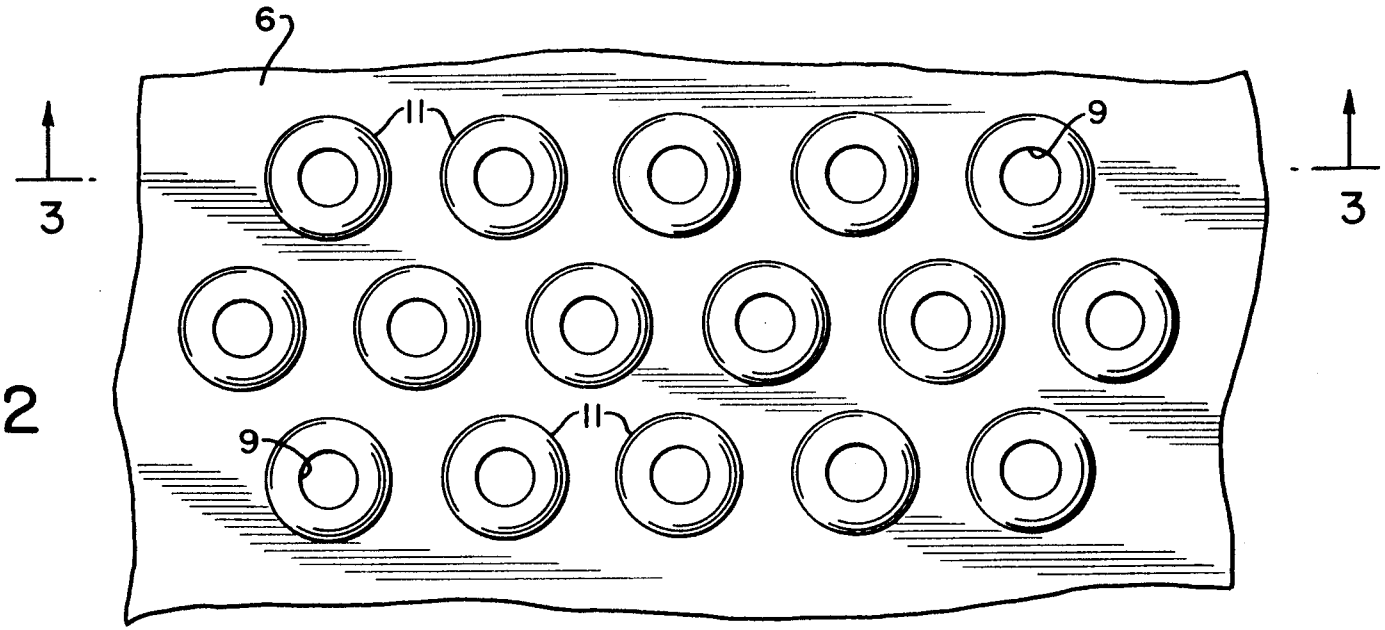
FIG. 2 is a schematic representation of the three rows of small orifices disposed on the side of the shroud.
Figure 3:
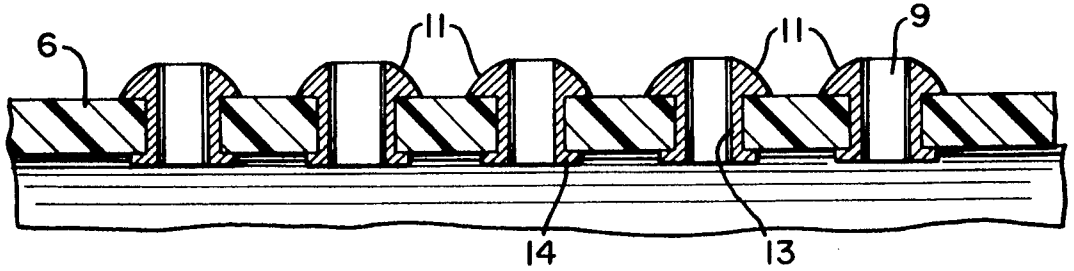
FIG. 3 is a schematic cross sectional view of a row of orifices in the shroud.

As shown in greater detail in FIG. 2, the small exhaust orifices each are provided with heat transfer means or heat accumulators 9. As shown in FIG. 3, the heat accumulators are applied outside and inside of the orifices 11 with a metal liner portion 13 in each hole and an interior retainer portion 14 holding the accumulator 11 in place in relation to each small exhaust orifice 9.

The heat accumulator 11 is of a metal which suitably has a lower heat capacity than steel. For example, aluminum is such a metal. This permits the hot air exhausting through the orifices to heat the heat accumulator which then, by radiation, transmits its heat content to the adjacent hair and also has a post warming effect on the hot air exiting past the heat accumulator.

The provision of the large exhaust orifice is not essential, but when one is provided on a dryer, then the dryer should suitably be used in association with a flow constrictor 15, the larger opening 17 which can be fitted over the large exhaust orifice in the barrel 6, and the smaller opening 19 creates a back pressure in the barrel 6. This back pressure increases the flow and pressure of air exiting through the small exhaust orifices 9.

Figure 4:
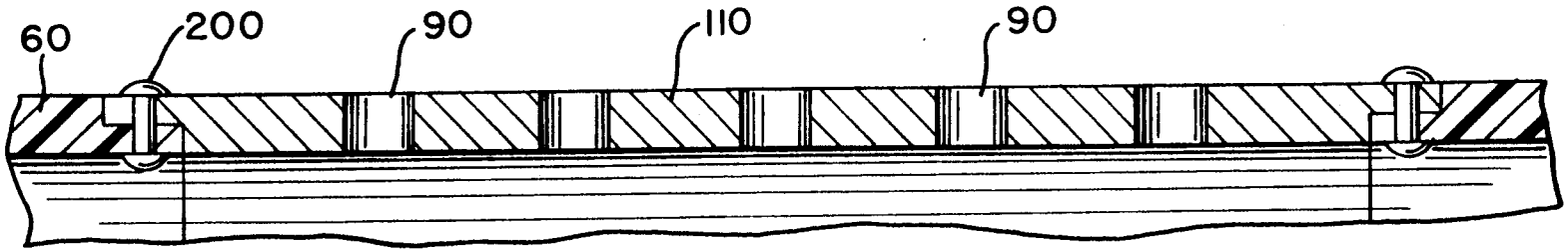
FIG. 4 is a schematic cross sectional representation of a shroud having another embodiment of orifice and heat accumulator disposition therein.

The heat from the hair dryer also makes the hair more manageable during the drying process, as well as the intensity of the heat is proportional to the drying rate. The coarser the hair, the more heating it requires to make it manageable and to maintain a desirably high rate of drying. Most of natural African hair requires a greater amount of heat for the same rate and manageability of drying, than would be required for finer, less coarse hair. In FIG. 4 an embodiment of the present invention is shown using a heat accumulator 110 which can communicate a greater amount of heat than the heat accumulator 11.

The heat accumulator 110 is a solid piece of metal containing a plurality of orifices 90, suitably arranged in several rows. Therefore, the heat accumulator 110 is disposed generally within a correspondingly shaped cutout in the barrel 60 and is attached thereto as shown at 200. A plurality of orifices in one or more rows are disposed within the heat accumulator 110 of this embodiment of the present invention, to provide for an increased rate of heat transfer to courser hair.

Suitably a hair dryer 1 in accordance with the present invention can be provided with a plurality of alternate shrouds 6, 60, depending on the number and variety of orifice constructions for given hair drying conditions and desired hair drying rates.

Figure 5:
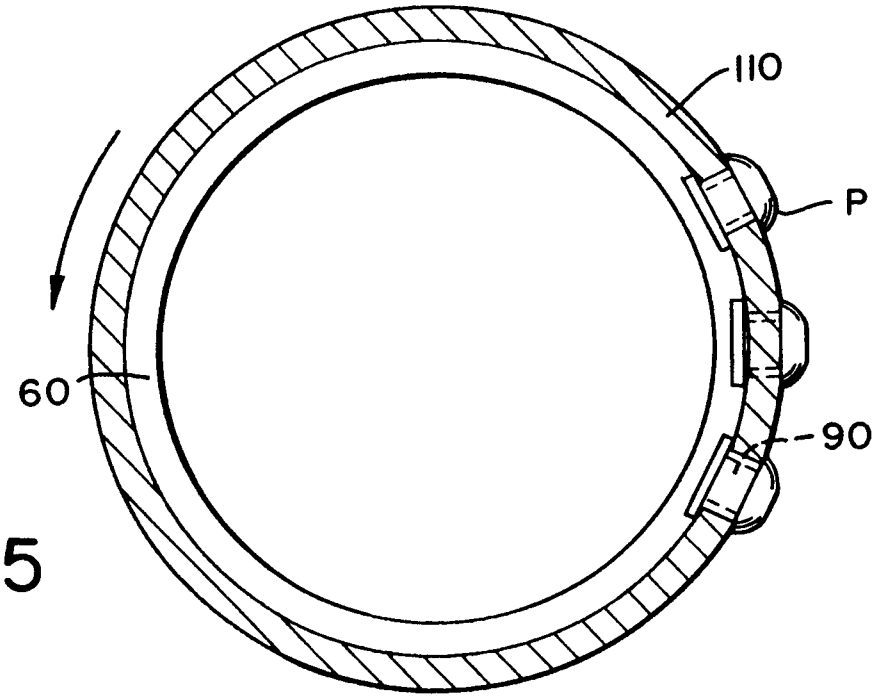
FIG. 5 is schematic representation of the rotatability of the shroud.

As shown schematically in FIG. 5, the shroud 60 with a heat accumulator 110 on it can suitably be rotated on the hair dryer for easily bringing the orifices 90 to a suitable circumferential position on the barrel, depending on the hand used by the operator and the most convenient attitude for making the orifices face the hair to be dried.

Although the shroud or barrel 6, 60 were referred to for the sake of simplicity as having a circular cross section, this is not an essential feature of the invention nor is the hair dryer 1 shown in FIG. 1 necessarily the only type and shape of hair dryer to which the present invention can be applied. The small exhaust orifices 9, 90 and heat accumulators 11, 110 can be readily adapted by any person having average skill in the art to any conventional existing, or future hair dryer shape and design.

I claim:

1. A hair dryer having means for blowing air; an electrical heater for heating the blown air, and a shroud surrounding said heater for providing passage of the heated air therethrough, the improvement which comprises a plurality of air exhaust orifices in a part of said shroud for discharge of blown, heated air therethrough to the exterior of the shroud, metallic secondary heat transfer means associated with said orifices for improving the transfer of heat to the exterior of the shroud, an air exhaust opening in said shroud, said opening having a diameter that is larger than the diameter of each of said orifices, said exhaust opening being disposed downstream of said orifices, and being partially covered by an air flow constrictor.

2. The hair dryer of claim 1, wherein said orifices are arranged in a single row disposed adjacent to, forward of, or both adjacent to and forward of said electrical heater.

3. The hair dryer of claim 1, wherein said orifices are arranged in a plurality of rows, disposed adjacent to, forward of, or both adjacent to and forward of said electrical heater.

4. The hair dryer of claim 1, wherein said secondary heat transfer means comprises metallic heat accumulator means each disposed about the periphery of a different one of said orifices while leaving the center of the orifice free for air flow.

5. The hair dryer of claims 4, wherein a metallic part of said metallic heat accumulator means is disposed both within and outside said shroud.

6. The hair dryer of claim 1, wherein said secondary heat transfer means comprises a single metallic member on said shroud, said member having formed therein at least one row of said orifices.

7. The hair dryer of claim 6, wherein said single metallic member is fastened into a corresponding cutout in said shroud.

8. The hair dryer of claim 1, wherein said metal is aluminum.

9. The hair dryer of claim 1, wherein the part of said shroud that contains the orifices is rotatable relative to the rest of the shroud, for rotating the orifices into any desired angular position along the circumference of said shroud relative to the direction of air flow through said shroud.

10. The hair dryer of claim 1, wherein said shroud is removable from said hair dryer and can be exchanged for another shroud.

11. The hair dryer of claim 1, wherein said shroud has an annular cross section, and said orifices are disposed over a minor part of the circumference of said shroud.

12. The hair dryer of claim 1, wherein each of said orifices has a diameter of from about $\frac{1}{4}$ centimeter to about 2 centimeters.

13. The hair dryer of claim 1, wherein each of said orifices has a diameter of from about $\frac{1}{2}$ centimeter to about $\frac{3}{4}$ centimeter.

* * * * *